US011583047B2

(12) United States Patent
Kim

(10) Patent No.: US 11,583,047 B2
(45) Date of Patent: Feb. 21, 2023

(54) LUNCH BOX CONTAINER

(71) Applicant: Kyung Sun Kim, Incheon (KR)

(72) Inventor: Kyung Sun Kim, Incheon (KR)

(73) Assignee: FLEXNLOCK, Incheon (KR)

( * ) Notice: Subject to any disclaimer, the term of this patent is extended or adjusted under 35 U.S.C. 154(b) by 649 days.

(21) Appl. No.: 16/596,075

(22) Filed: Oct. 8, 2019

(65) Prior Publication Data

US 2021/0037940 A1 Feb. 11, 2021

(30) Foreign Application Priority Data

Aug. 8, 2019 (KR) ..... 10-2019-0096463

(51) Int. Cl.

| | |
|---|---|
| ***A45C 11/20*** | (2006.01) |
| ***A45C 7/00*** | (2006.01) |
| ***A45C 13/02*** | (2006.01) |
| ***B65D 1/36*** | (2006.01) |

(52) U.S. Cl.

CPC ..... *A45C 11/20* (2013.01); *A45C 7/0086* (2013.01); *A45C 13/02* (2013.01); *B65D 1/36* (2013.01)

(58) Field of Classification Search

CPC ..... A45C 11/20; A45C 7/0086; A45C 13/02; B65D 1/36

See application file for complete search history.

(56) References Cited

U.S. PATENT DOCUMENTS

| | | | | |
|---|---|---|---|---|
| 8,328,247 | B2 * | 12/2012 | Tonelli | A45C 13/1084 292/110 |
| 2006/0201950 | A1 * | 9/2006 | Liu | B65D 1/36 220/521 |
| 2011/0114526 | A1 * | 5/2011 | Neumann | A45C 11/20 206/459.5 |
| 2014/0103033 | A1 * | 4/2014 | Beckman | B65D 1/34 220/4.01 |
| 2016/0037886 | A1 * | 2/2016 | Edwards | B65D 81/38 206/541 |

FOREIGN PATENT DOCUMENTS

| | | | |
|---|---|---|---|
| CN | 2774240 | | 4/2006 |
| JP | 2015029879 | | 2/2015 |
| KR | 200316999 | Y1 * | 6/2003 |
| KR | 200406266 | Y1 * | 1/2006 |
| KR | 100621855 | | 9/2006 |
| KR | 200451988 | | 1/2011 |
| KR | 20170077565 | | 7/2017 |
| KR | 2020190000415 | | 2/2019 |

* cited by examiner

*Primary Examiner* — Tri M Mai

(74) *Attorney, Agent, or Firm* — Cantor Colburn LLP

(57) ABSTRACT

Provided is a lunch box container including a lower housing that is formed to have an inner containing space; an upper housing that is hinged to one edge of the lower housing and is rotatable; an inner case contained in the lower housing and provided with partition walls to separate a plurality of inner spaces; and a locking wing that is formed on the other edge of the lower housing or the upper housing. The upper housing includes a trench portion formed on a lower surface to correspond to an upper end portion of the inner case.

6 Claims, 4 Drawing Sheets

LUNCH BOX CONTAINER

BACKGROUND OF THE INVENTION

1. Field of the Invention

The present invention relates to a lunch box container.

2. Description of the Related Art

A generally used lunch box container is configured to contain contents such as boiled rice or side dishes after a plurality of compartments are prepared in a main body made by injection-molding a synthetic resin, and prevents contents contained therein from spilling out or foreign objects from entering by coupling a lid to the top of the main body. Further, a food tray used in a school cafeteria or an autonomous restaurant is usually formed of a stainless steel and is integrally configured by container portions of various sizes so as to contain boiled rice, soup, and side dishes.

However, the lunch box container formed of the synthetic resin has a problem in which environmental hormones or the like are generated when hot foods are contained therein, and the food tray formed of the stainless steel has a high thermal conductivity, and thereby, there is a risk of burning or spilling hot foods when the hot foods are contained therein.

Further, such a lunch box container and the food tray has a disadvantage in which due to the structure, the lunch box container may not be used as a substitute for the food tray, or the food tray may not be used as a substitute for the lunch box container.

In this regard, Korean Patent Registration No. 10-0621855 (name of the invention: airtight type lunch-basket container) discloses an airtight type lunch box container which is capable of being sealed and is not inconvenient to hold the container by hand even when hot food is contained therein.

SUMMARY OF THE INVENTION

In order to solve the above-described problems, the present invention provides a lunch box container which is configured with an inner case and an outer case and in which the inner case including a plurality of compartments is formed of silicon and maintains a close contact with the outer case and thereby the sealability is improved.

However, the technical problems to be solved by the present embodiment is not limited to the technical problems described above, and further technical problem may exist.

As technical means to solve the above-described technical problems, a lunch box container according to one embodiment of the present invention includes a lower housing that is formed to have an inner containing space; an upper housing that is hinged to one edge of the lower housing and is rotatable; an inner case contained in the lower housing and provided with partition walls to separate a plurality of inner spaces; and a locking wing that is formed on the other edge of the lower housing or the upper housing. The upper housing includes a trench portion formed on a lower surface to correspond to an upper end portion of the inner case.

Advantageous Effects

According to the above-described problem-solving means of the present invention, an outer case configured with an upper housing and a lower housing may be fixed and coupled to be attachable and detachable by a protrusion and a groove formed to correspond to an inner case.

In addition, since an inner side surface of the upper housing and an upper end portion of the inner case formed of a silicon material comes into close contact with each other, a lunch box container may maintain sealability.

BRIEF DESCRIPTION OF THE DRAWINGS

FIG. 1A illustrates a state in which an inner case is mounted in an inner containing space of a lower housing, and FIG. 1B illustrates a state in which the inner case is removed from the lower housing.

FIG. 2A illustrates the lunch box container in the locked state in which an upper housing is disposed upwardly, and FIG. 2B Illustrates the lunch box container in the locked state in which the lower housing is disposed upwardly.

FIG. 3A is a back view of the lunch box container, FIG. 3B is a left side view of the lunch box container, FIG. 3C is the plan view of the lunch box container, FIG. 3D is a right side view of the lunch box container, and FIG. 3E is a front view of the lunch box container.

DETAILED DESCRIPTION OF THE EMBODIMENT

Figure 1A:
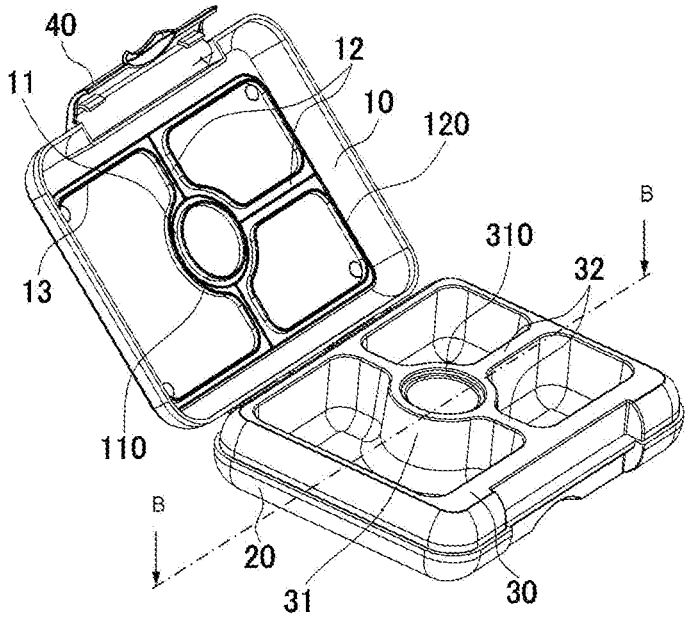
FIG. 1A and FIG. 1B are a perspective view illustrating an open state of a lunch box container according to an embodiment of the present invention.

Hereinafter, an embodiment of the present invention will be described in detail with reference to the accompanying drawings such that those skilled in the art to which the present invention belongs may easily perform. The present invention may, however, be embodied in many different forms and is not limited to the embodiment described herein. In order to clearly illustrate the present invention, parts not related to the description are omitted in the drawings, and similar parts are denoted by similar reference numerals or symbols throughout the specification.

Throughout the specification, when a part is referred to as being "connected" to another part, this includes not only "directly connected" but also "electrically connected" with another element therebetween. In addition, when a part is referred to as "including" a configuration element, it means that the configuration element does not exclude other configuration elements but may further include other configuration elements unless describes otherwise in particular, and it is to be understood that the configuration element does not preclude presence or addition of one or more other features, numerals, steps, operations, configuration elements, components, or a combination thereof.

Figure 1B:
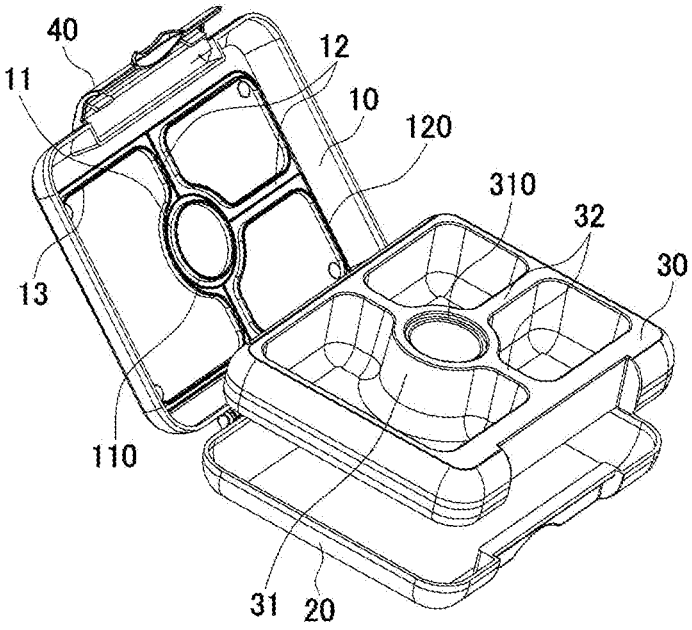

FIGS. 1A and 1B are perspective views illustrating an open state of a lunch box container according to an embodiment of the present invention.

FIG. 1A illustrates a state in which an inner case 30 is mounted in an inner containing space of a lower housing 20, and FIG. 1B illustrates a state in which the inner case 30 is removed from the lower housing 20.

Referring to FIGS. 1A and 1B, the lunch box container of the present invention includes a lower housing 20 formed to have an inner containing space, an upper housing 10 which is hinged to one edge of the lower housing 20, an inner case 30 which is contained in the lower housing 20 and is provided with partition walls 31 and 32 so as to partition a plurality of inner spaces, and a locking wing 40 formed on the other edge of the lower housing 20 or the upper housing 10. The upper housing 10 includes trench portions 11, 12, and 13 formed on a lower surface thereof to correspond to an upper end portion of the inner case 30 and the partition walls 31 and 32 thereof. Here, the inner case 30 may be formed of silicon.

That is, referring to FIG. 1A, the partition walls 31 and 32 and an edge portion of the inner case 30 come into close contact with the trench portions 11, 12, and 13 formed on a lower surface of the upper housing 10, and thereby, sealability of food stored in the inner case 30 may be maintained. In addition, due to the silicon material forming the inner case 30, airtightness may be maintained without providing separate packing in the upper housing 10.

In addition, referring to FIG. 1B, the inner case 30 may be detachable from an outer case formed of the upper housing 10 and the lower housing 20. Accordingly, only the inner case 30 may be separated from the outer case and efficiently managed when the lunch box container is used, such as when storing the food in the inner case or washing the inner case. Further, food left in the inner case 30 may be easily removed by an elastic force of the silicone material.

Figure 2A:
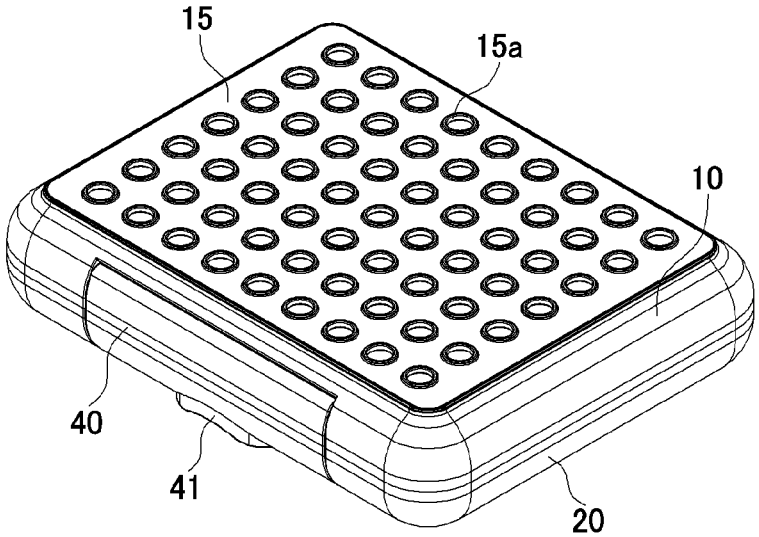
FIG. 2A and FIG. 2B are a perspective view illustrating a locked state of the lunch box container according to the embodiment of the present invention.
Figure 2B:
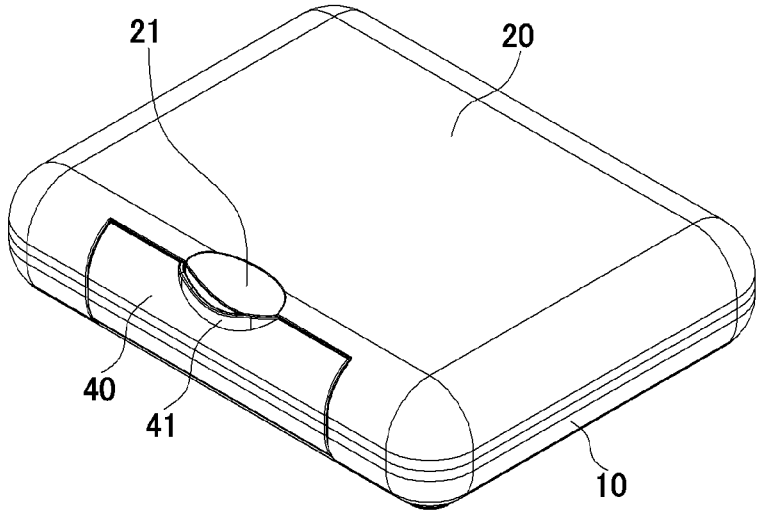

FIGS. 2A and 2B are perspective views illustrating a locked state of the lunch box container according to the embodiment of the present invention.

FIG. 2A illustrates the lunch box container in the locked state and the upper housing 10 is disposed upwardly, and FIG. 2B illustrates the lunch box container in the locked state and the lower housing 20 is disposed upwardly.

For example, referring to FIGS. 2A and 2B, the locking wing 40 may be hinged to the other edge of the upper housing 10 and may be fitted into a hook groove 201 formed in the lower housing 20. As another example, the locking wing 40 may be hinged to the other edge of the lower housing 20 and may be fitted into the hook groove formed in the upper housing 10. At this time, a detailed description on the locking wing 40 to be fitted into the hook groove 201 and a locked structure will be made below with reference to FIG. 5.

The upper housing 10 may include a plurality of coupling grooves 15*a* arranged in an outer upper surface 15 of the upper housing 10 at regular intervals. For example, the outer upper surface 15 of the upper housing 10 may be formed of an elastic material, and the coupling groove 15*a* may be formed in a circular shape and arranged in parallel, but are not limited thereto. For example, the coupling groove 15*a* may be attached to or detached from a separate accessory having a coupling protrusion formed to correspond to the coupling groove 15*a*. For example, the accessory may be formed in the form of various animal characters, or a consonant and a vowel, and a user may randomly decorate the outer upper surface 15 of the lunch box container by using the accessory.

For example, the upper surface 15 of the upper housing 10 may be formed of a transparent material. Due to this, it is possible to check the kind of food stored in the inner case 30.

Figure 3A:
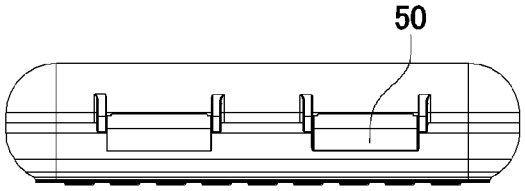
FIG. 3A to FIG. 3E are a plan view and a side view of the lunch box container according to the embodiment of the present invention.
Figure 3B:
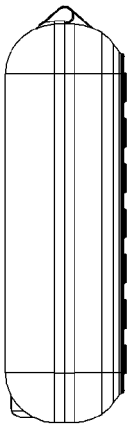
Figure 3C:
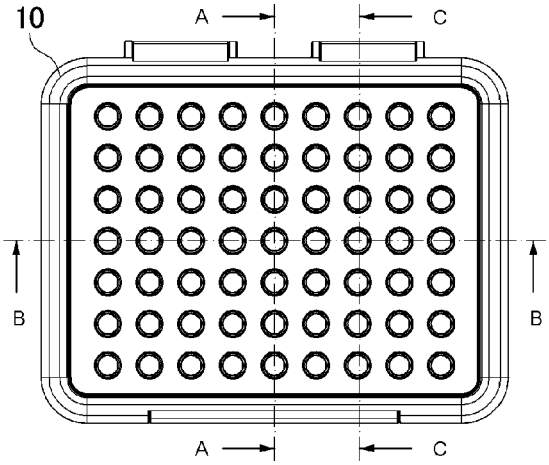
Figure 3D:
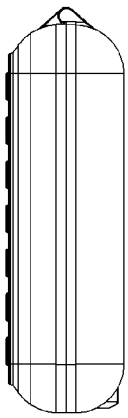
Figure 3E:
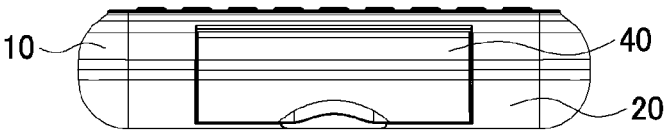

FIGS. 3A to 3E illustrate a plan view and a side view of the lunch box container according to the embodiment of the present invention. FIG. 3A is a back view of the lunch box container, FIG. 3B is a left side view of the lunch box container, FIG. 3C is a top plan view of the lunch box container, FIG. 3D is a right side view of the lunch box container, and FIG. 3E is a front view of the lunch box container.

Referring to FIGS. 3A to 3E, the lunch box container according to the present invention may include at least two hinges 50 connected to one edge of the lower housing 20 or the upper housing 10 so as to pivot in a hinged manner.

Figure 4:
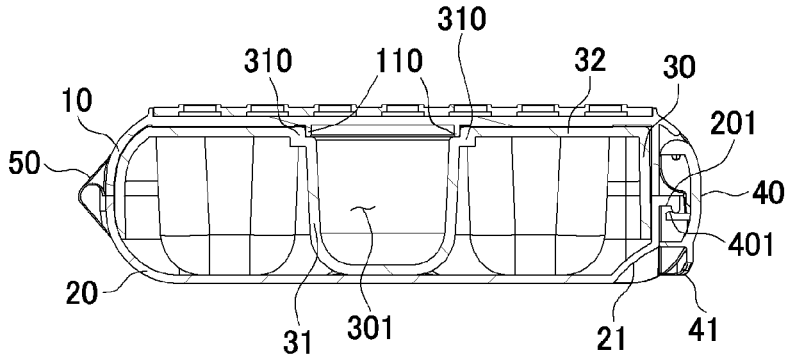
FIG. 4 is a cross-sectional view taken along a line A-A of FIG. 3C.
Figure 5:
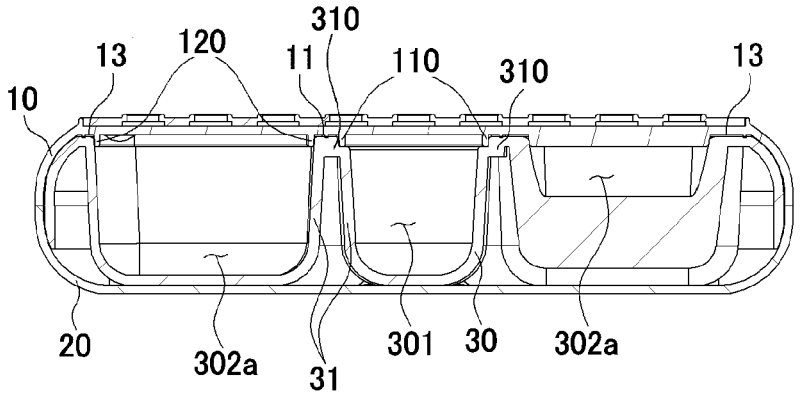
FIG. 5 is a cross-sectional view taken along a line B-B of FIG. 1A and FIG. 3C.
Figure 6:
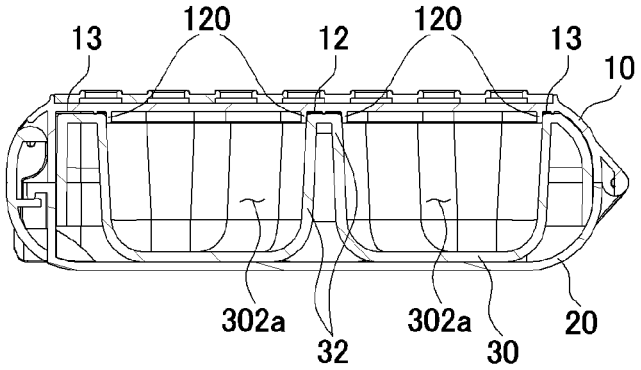
FIG. 6 is a cross-sectional view taken along a line of C-C of FIG. 3C.

FIG. 4 is a cross-sectional view taken along a line A-A of FIG. 3C, FIG. 5 is a cross-sectional view taken along a line B-B of FIG. 3C, and FIG. 6 is a cross-sectional view taken along a line CC of FIG. 3C.

Specifically, referring to FIGS. 1A and 1B, the inner case 30 may be formed in a box shape and may include an edge portion forming an outer wall, a first partition wall 31 located at a middle region, and a second partition wall 32 extending to the first partition wall from the outer wall.

The trench portions 11-13 formed in the upper housing 10 may include a first trench portion 11 recessed such that the first partition wall 31 is inserted, a second trench portion 12 recessed such that the second partition wall 32, and a third trench portion 13 recessed such that the outer wall is inserted, thereby sealing the inner case 30.

For example, as illustrated in FIG. 1A and FIG. 1B, the first partition wall 31 may form a cylindrical inner space but is not limited thereto and may form a polygonal inner space such as a triangular column, a square column, and a hexagonal column.

FIG. 4 illustrates a cross section of a line A-A of FIG. 3C and is a cross-sectional view taken along the second partition wall 32 extending vertically from a central portion of the first partition wall 31.

For example, referring to FIGS. 1A, 1B, and 4, the first partition wall 31 may partition a cylindrical inner space 301. The first partition wall 31 may include a ring-shaped mounting groove 310 which is formed on an upper end portion thereof and is adjacent to an inner circumferential surface thereof.

Referring to FIGS. 1A, 1B, and 4, the upper housing 10 may include a circular first protrusion 110 located inside the first trench 11. Here, the first protrusion 110 may be mounted in a mounting groove 310 to seal the cylindrical inner space 301.

FIG. 5 illustrates a cross section of B-B of FIG. 1A and FIG. 3C, and is a cross-sectional view taken along a line adjacent to the second partition wall 32 extending horizontally from a central portion of the first partition wall 31.

For example, referring to FIGS. 1A, 1B, and 5, the second partition wall 32 may separate at least three inner spaces 302*a* surrounding the first partition wall 31. For example, as illustrated in FIGS. 1A and 1B, the second partition wall 32 extends perpendicularly and horizontally from the center of the first partition wall 31 so as to be orthogonal and may be disposed to be perpendicular to the edge portion of the inner case 30. That is, the second partition wall 32 may be disposed between the first partition wall 31 and the edge portion of the inner case 30 and may separate a plurality of the inner spaces 302*a*. As another example, the second partition wall 32 may separate four inner spaces 302*a* surrounding the first partition wall 31.

For example, as illustrated in FIG. 5, the first partition wall 31 that separates the circular inner space 301 and the polygonal inner spaces 302*a* adjacent to the circular inner space 301 may be configured by a double wall and upper end portions of the double wall may be formed to be connected to each other.

Here, the first partition wall 31 may include an upper end portion of a stepped shape connected to the mounting groove 310, and the upper end portion of the first partition wall 31 may be inserted into the first trench portion 11 of the upper housing 10.

As another example, the plurality of polygonal inner spaces 302*a* may be formed to have the same depth, but is not limited thereto, and may be formed to have various depths depending on a usage.

FIG. 6 illustrates a cross section of C-C of FIG. 3C and is a cross-sectional view taken along a parallel line separated by a predetermined interval from the second partition wall 32 vertically extending from a central portion of the first partition wall 31.

For example, referring to FIGS. 1A, 1B, and 6, the upper housing 10 may include second protrusions 120 which are located outside the first trench portion 11 and the inside of the third trench portion 13 and are partitioned into at least three parts by the second trench portion 12. In this case, the three second protrusions 120 may seal the three inner spaces 302*a* formed in the inner case 30.

As another example, the upper housing 10 may include the second protrusions 120 which are located outside the first trench portion 11 and the inside of the third trench portion 13 and are partitioned into at least four parts by the second trench portion 12. In this case, the four second protrusions 120 may seal the four inner spaces 302*a* formed in the inner case 30.

For example, as illustrated in FIG. 6, the second partition wall 32 that separates the neighboring polygonal inner spaces 302*a* may be configured by a double wall, and the upper end portions of the double wall may be formed to be connected to each other. Here, an upper end portion of the second partition wall 32 may be inserted into the second trench portion 12 of the upper housing 10. Further, the edge portion of the inner case 30 may be inserted into the third trench portion 13 formed on a lower surface of the upper housing 10.

Accordingly, if an outer case configured by the upper housing 10 and the lower housing 20 is closed, an upper end portion of the inner case 30 may be fitted into the first to third trench portions 11-13 formed on the lower surface of the upper housing 10. That is, the upper housing 10 may seal the inner spaces 301 and 302*a* of the inner case 30 and fix the inner case 30 so as not to shake in the outer case at the same time.

Meanwhile, referring to FIGS. 2A, 2B, and 4, the locking wing 40 is coupled to rotate in a hinged manner, and may include a handle portion 41 protruding outwardly from a lower middle portion and a hook protrusion 401 formed on an inner side surface of the locking wing 40.

For example, an upper end portion of the locking wing 40 may be coupled to the upper housing 10 so as to rotate in a hinged manner and may rotate the locking wing 40 upwardly.

The lower housing 20 may include a handle groove 21 recessed inwardly in a region corresponding to the handle portion 41 when the lock wing 40 is locked, and the hook groove 201 which is formed to protrude on a left edge of the lower housing 20 and is interlocked with the hook protrusion 401.

For example, as illustrated in FIG. 4, the hook protrusion 401 may protrude toward an inner side surface of the locking wing 40 and may be formed in a shape bent upwardly. Further, the hook groove 201 may protrude outwardly from the other edge of the lower housing 20 and may be formed in a shape bent downwardly.

Accordingly, if a finger is inserted into the handle portion 41 which is symmetrical to the handle groove 21 to apply an external force upwardly when locking the locking wing 40, the hook protrusion inserted into the hook groove 201 may be easily pulled out.

The embodiments of the present invention described above is simply exemplary, and those skilled in the art will be able to understand that the embodiments may be easily modified in other specific forms without changing the technical idea or an essential feature of the present invention. Therefore, it should be understood that the embodiments described above are exemplary in all respects and not restrictive. For example, each component described as a single type may be implemented in a distributed manner, and similarly, configuration elements described in a distributed manner may be implemented in a combined form.

The scope of the present invention is defined by the appended claims rather than the detailed description, and it should be construed that all changes or modifications derived from the meaning and scope of the claims and their equivalents are included in the scope of the present invention.

What is claimed is:

1. A lunch box container comprising:

a lower housing that is formed to have an inner containing space;

an upper housing that is hinged to one edge of the lower housing and is rotatable;

an inner case that is contained in the inner containing space of the lower housing and provided with partition walls to separate a plurality of inner spaces, wherein the inner case is formed of a silicon material; and a locking wing that is formed on the other edge of the lower housing or the upper housing, wherein the upper housing includes a trench portion formed on a lower surface to correspond to an upper end portion of the inner case, wherein the partition walls of the inner case include: a first partition wall located in a middle region; and a second partition wall extending to be orthogonal by using the first partition wall as a center, wherein the trench portion of the upper housing includes: a first trench portion recessed such that the first partition wall is inserted into the first trench portion; a second trench portion extending to be orthogonal by using the first trench portion as a center; and a third trench portion extending from the second trench portion so as to fix an edge portion of the inner case, and wherein an upper surface the upper housing includes a plurality of coupling grooves arranged in parallel at regular intervals.

2. The lunch box container according to claim 1, wherein the first partition wall separates a cylindrical inner space from others and includes a ring-shaped mounting groove which is formed in an upper end portion and is adjacent to an inner circumferential surface of the first partition wall, wherein the upper housing includes a circular first protrusion portion located inside the first trench portion, and wherein the first protrusion portion is mounted in the mounting groove to seal the cylindrical inner space.

3. The lunch box container according to claim 1, wherein the second partition wall separates at least three internal spaces surrounding the first partition wall, wherein the upper housing includes at least three second protrusion portions which are located outside the first trench portion and inside the third trench portion and are separated by the second trench portion, and wherein the three second protrusion portions seal the three inner spaces.

4. The lunch box container according to claim 1, wherein the locking wing is coupled to rotate in a hinged manner, and wherein the locking wing includes a handle portion protruding outwardly from a lower middle portion, and a hook projection formed on an inner side surface of the lock wing.

5. The lunch box container according to claim 4, wherein the lower housing includes a handle groove that is recessed inwardly in a region corresponding to the handle portion when locking the lock wing; and a hook groove that is formed to protrude in the other edge of the lower housing and is interlocked with the hook protrusion.

6. The lunch box container according to claim 1, wherein an upper surface of the upper housing is formed of a transparent material.

* * * * *